United States Patent [19]

Fujimoto et al.

[11] Patent Number: 4,926,828

[45] Date of Patent: May 22, 1990

[54] AIR-FUEL RATIO FEEDBACK CONTROL METHOD FOR INTERNAL COMBUSTION ENGINES

[75] Inventors: Sachito Fujimoto; Shuichi Hosoi, both of Wako, Japan

[73] Assignee: Honda Giken Kogyo K.K., Tokyo, Japan

[21] Appl. No.: 310,869

[22] Filed: Feb. 14, 1989

[30] Foreign Application Priority Data

Mar. 1, 1988 [JP] Japan ..... 63-49182

[51] Int. Cl.[5] ..... F02D 41/14

[52] U.S. Cl. ..... 123/489; 123/440

[58] Field of Search ..... 123/440, 489

[56] References Cited

U.S. PATENT DOCUMENTS 4,651,700 3/1987 Kobayashi et al. ..... 123/440 X

FOREIGN PATENT DOCUMENTS 1343 1/1985 Japan .

*Primary Examiner*—Tony M. Argenbright

*Attorney, Agent, or Firm*—Arthur L. Lessler

[57] ABSTRACT

An air-fuel ratio feedback control method for an internal combustion engine in which when the engine is operating in a feedback control region, the concentration of an ingredient in exhaust gases from the engine is detected by an exhaust gas ingredient concentration sensor arranged in the exhaust system of the engine and compared with a reference value, and the air-fuel ratio of an air-fuel mixture to be supplied to the engine is controlled to a desired value in a feedback manner responsive to the result of the comparison. Atmospheric pressure is detected, and the reference value is set to a value depending on the detected value of atmospheric pressure. The reference value is set to a higher value as the detected value of atmospheric pressure is lower. The reference value is set to a lower value when the engine is operating in an idling region than when the engine is operating in a region other than the idling region.

3 Claims, 4 Drawing Sheets

KO2 CALCULATING SUBROUTINE
201
O2 SENSOR ACTIVATED ?
202
OPEN LOOP ?
203
OPEN LOOP CONTROL EXECUTED IN LOOP BEFORE LAST LOOP ?
204
θTH>θIDL IN LOOP BEFORE LAST LOOP ?
206
θTH>θIDL IN PRESENT LOOP ?
207
KO2 = CR×KREF1
208
KO2 HELD IN LOOP BEFORE LAST LOOP ?
209
AT IDLE ?
210
θTH>θIDL IN LOOP BEFORE LAST LOOP ?
212
θTH>θIDL IN PRESENT LOOP ?
Yes
No
TO 216
TO 215
TO 213
TO 211
TO 227
TO 205
TO 223

AIR-FUEL RATIO FEEDBACK CONTROL METHOD FOR INTERNAL COMBUSTION ENGINES

BACKGROUND OF THE INVENTION

The present invention relates to a method of feedback-controlling the air-fuel ratio of an air-fuel mixture being supplied to an internal combustion engine, and more particularly to a method of this kind which is adaped to control the air-fuel ratio when the vehicle is running in high altitudes.

An air-fuel ratio feedback control method for internal combustion engines is widely known, e.g. from Japanese Provisional Patent Publication (Kokai) No. 60-1343 owned by the assignee of the present application, which controls the air air-fuel ratio of an air-fuel mixture being supplied to an internal combustion engine by the use of a coefficient variable in response to the output of an exhaust gas ingredient concentration sensor arranged in the exhaust system of the engine during operation in an predetermined air-fuel ratio feedback control region.

This known method comprises determining whether the engine is operating in the feedback control region or in a region other than the former region, comparing the output of the exhaust gas ingredient concentration sensor with a predetermined reference value when the engine is operating in the feedback control region, and changing the value of the coefficient in accordance with the result of the comparison, so as to bring the air-fuel ratio of the air-fuel mixture to a desired value.

In the above method, the predetermined reference value is constant irrespective of atmospheric pressure of a place at which the engine is operating. Therefore, in high altitudes, atmospheric pressure becomes lower to decrease the exhaust pressure of the engine, so that the charging efficiency increases, which causes the amount of air drawn into the cylinders to increase relative to the amount of fuel drawn thereinto whereby the air-fuel ratio of the air-fuel mixture becomes leaner, which results in an increased amount of emission of NOx. Further, in high altitudes the air density is low and hence the output of the engine tends to be insufficient. Therefore, the driver is likely to depress the accelerator pedal more deeply, so that the frequency of high load operation of the engine with the throttle valve opening being large can be increased to cause an increase in the combustion temperature of the air-fuel mixture, resulting in that the tendency toward the increased amount of emission of NOx is further intensified.

SUMMARY OF THE INVENTION

It is therefore the object of the invention to provide an air-fuel ratio feedback control method for internal combustion engines which is capable of obtaining excellent exhaust emission characteristics not only in low altitudes but also in high altitudes.

To attain the above object, the present invention provides a method of effecting feedback control of the air-fuel ratio of an air-fuel mixture being supplied to an internal combustion engine having an exhaust system, and a sensor arranged in the exhaust system for sensing a value of the concentration of an ingredient in exhaust gases from the engine, wherein when the engine is operating in a feedback control region, the value of the concentration of an exhaust gas ingredient detected by the sensor is compared with a reference value, and the air-fuel ratio of the air-fuel mixture is controlled to a desired value in a feedback manner responsive to the result of the comparison.

The method according to the invention is characterized by comprising the steps of:

(1) detecting a value of atmospheric pressure, and (2) setting the reference value to a value depending on the detected value of atmospheric pressure.

Preferably, the reference value is set to a higher value as the detected value of atmospheric pressure is lower.

More preferably, the reference value is set to a lower value when the engine is operating in the idling region than when the egine is operating in the region other than the idling region. The above and other objects, features, and advantages of the invention will be more apparent from the ensuing detailed description taken in conjunction with the accompanying drawings.

DETAILED DESCRIPTION

The method according to the invention will not be described in detail with reference to the drawings showing an embodiment thereof.

Figure 1:
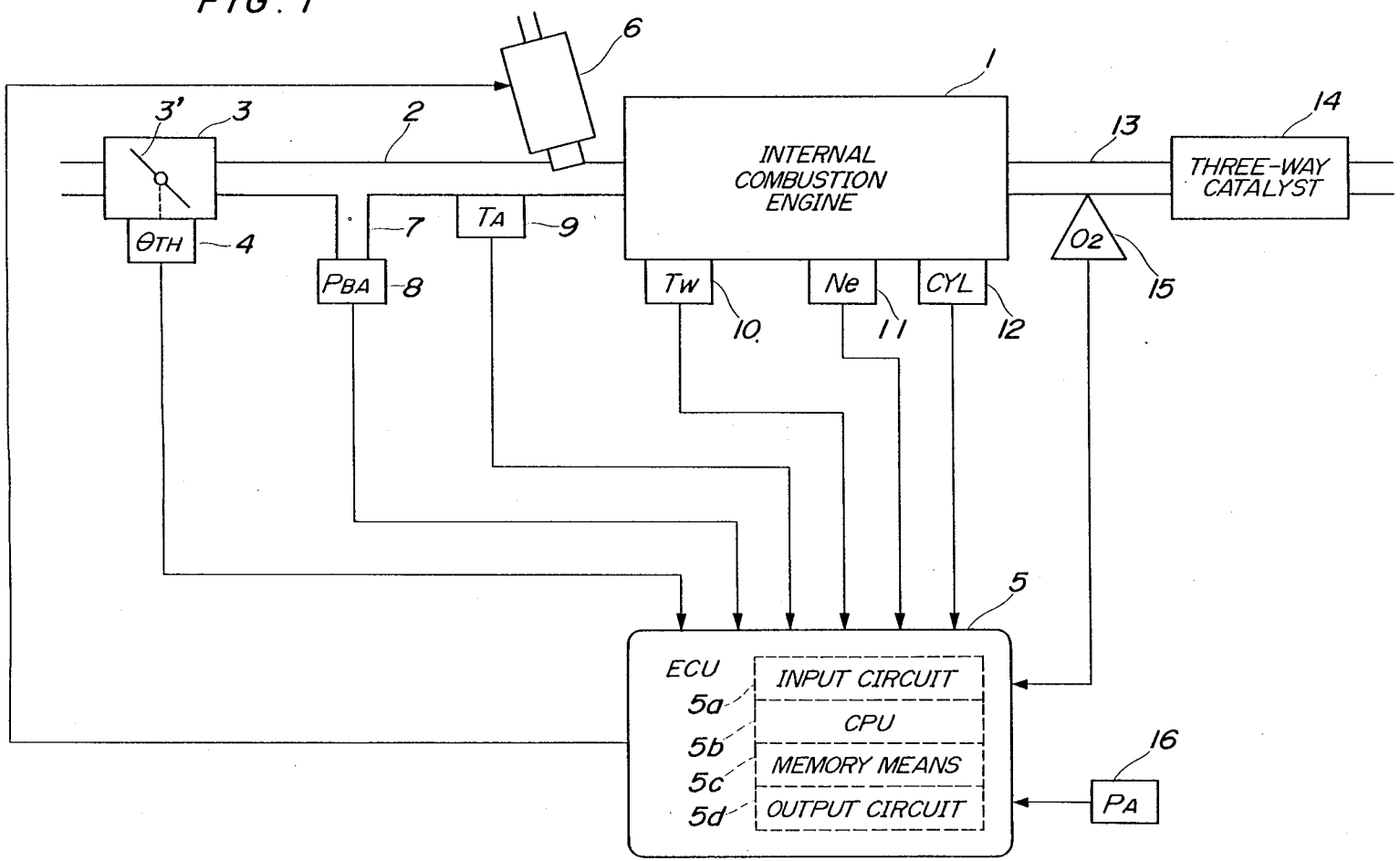
FIG. 1 is a block diagram illustrating the whole arrangement of a fuel supply control system for carrying out the method of the invention.

Referring first to FIG. 1, there is shown the whole arrangement of a fuel supply control system for an internal combustion engine, which is adapted to carry out the method according to the invention. In the figure, reference numeral 1 designates an internal combustion engine for automotive vehicles. Connected to the cylinder block of the engine 1 is an intake pipe 2 across which is arranged a throttle body 3 accommodating a throttle valve 3' therein. A throttle valve opening ($\theta_{TH}$) sensor 4 is connected to the throttle valve 3' for generating an electric signal indicative of the sensed throttle valve opening and supplying same to an electronic control unit (hereinafter called "the ECU") 5.

Fuel injection valves 6, only one of which is shown, are inserted into the interior of the intake pipe at locations intermediate between the cylinder block of the engine I and the throttle valve 3' and slightly upstream of respective intake valves, not shown. The fuel injection valves 6 are connected to a fuel pump, not shown, and electrically connected to the ECU 5 to have their valve opening periods controlled by signals therefrom.

On the other hand, an intake pipe absolute pressure ($P_{BA}$) sensor 8 is provided in communication with the interior of the intake pipe 2 at a location immediately downstream of the throttle valve 3' for supplying an electric signal indicative of the sensed absolute pressure within the intake pipe 2 to the ECU 5. An intake air temperature ($T_A$) sensor 9 is inserted intO the intake pipe 2 at a location downstream of the intake pipe absolute pressure sensor 8 for supplying an electric signal indicative of the sensed intake air temperature $T_A$ to the ECU 5.

An engine coolant temperature ($T_W$) sensor 10, which may be formed of a thermistor or the like, is mounted in the cylinder block of the engine 1, for supplying an electric signal indicative of the sensed engine coolant temperature $T_W$ to the ECU 5. An engine rotational speed (Ne) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO, and NOx. An $O_2$ sensor 15 as an exhaust gas ingredient concentraion sensor is mounted in the exhaust pipe 13 at a location upstream of the three-way catalyst 14, for sensing the concentration of oxygen present in exhaust gases emitted from the engine 1 and supplying an electric signal indicative of the sensed oxygen concentration to the ECU 5.

Further electrically connected to the ECU 5 is an atmospheric pressure ($P_A$) sensor 16 for supplying an electric singal indicative of the sensed atmospheric pressure $P_A$.

The ECU 5 comprises an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU") 5*b*, memory means 5*c* storing various operational programs which are executed in the CPU 5*b* and for storing results of calculations therefrom, etc., and an output circuit 5*d* which outputs a driving signal to the fuel injection valves 6.

The CPU 5*b* operates in response to the above-mentioned signals from the sensors to determine operating conditions in which the engine 1 is operating such as an air-fuel ratio feedback control region and open-loop control regions, and calculates, based upon the determined operating conditions, the valve opening period or fuel injection period $T_{OUT}$ over which the fuel injection valves 6 are to be opened, by the use of the following equation in synchronism with inputting of TDC signal pulses to the ECU 5.

$$T_{OUT}=T_i\times K_{02}\times K_1+K_2 \quad (1)$$

where $T_i$ represents a basic value of the fuel injection period $T_{OUT}$ of the fuel injection valves 6, which is determined based upon the engine rotational speed Ne and the intake pipe absolute pressure $P_{BA}$.

Figures 2, 2A, 2B:
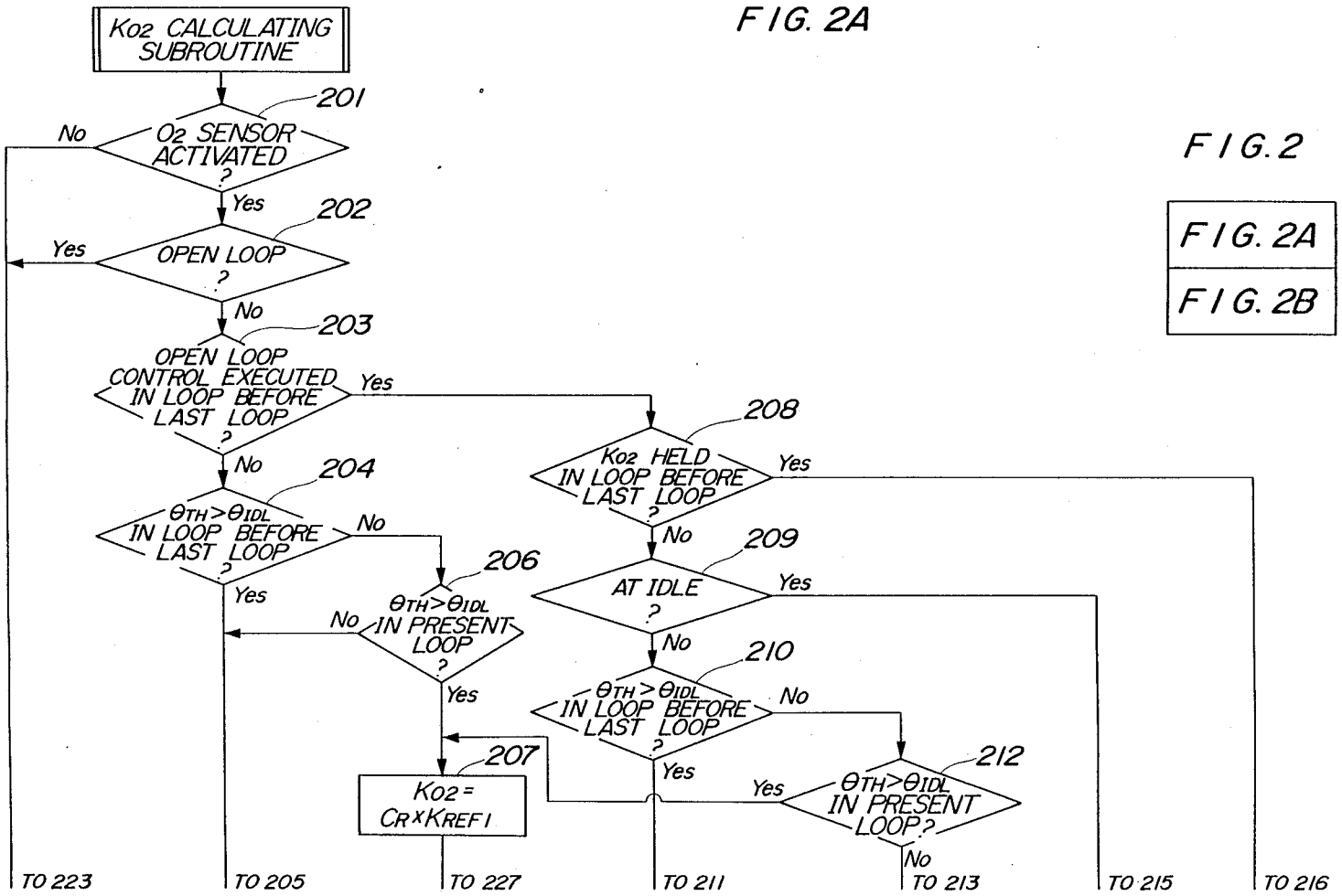
FIGS. 2A and 2B, hereafter collectively referred to as FIG. 2, constitute a flowchart of a subroutine for calculating a value of correction coefficient $K_{02}$ used in the air-fuel ratio feedback control.
Figure 2B:
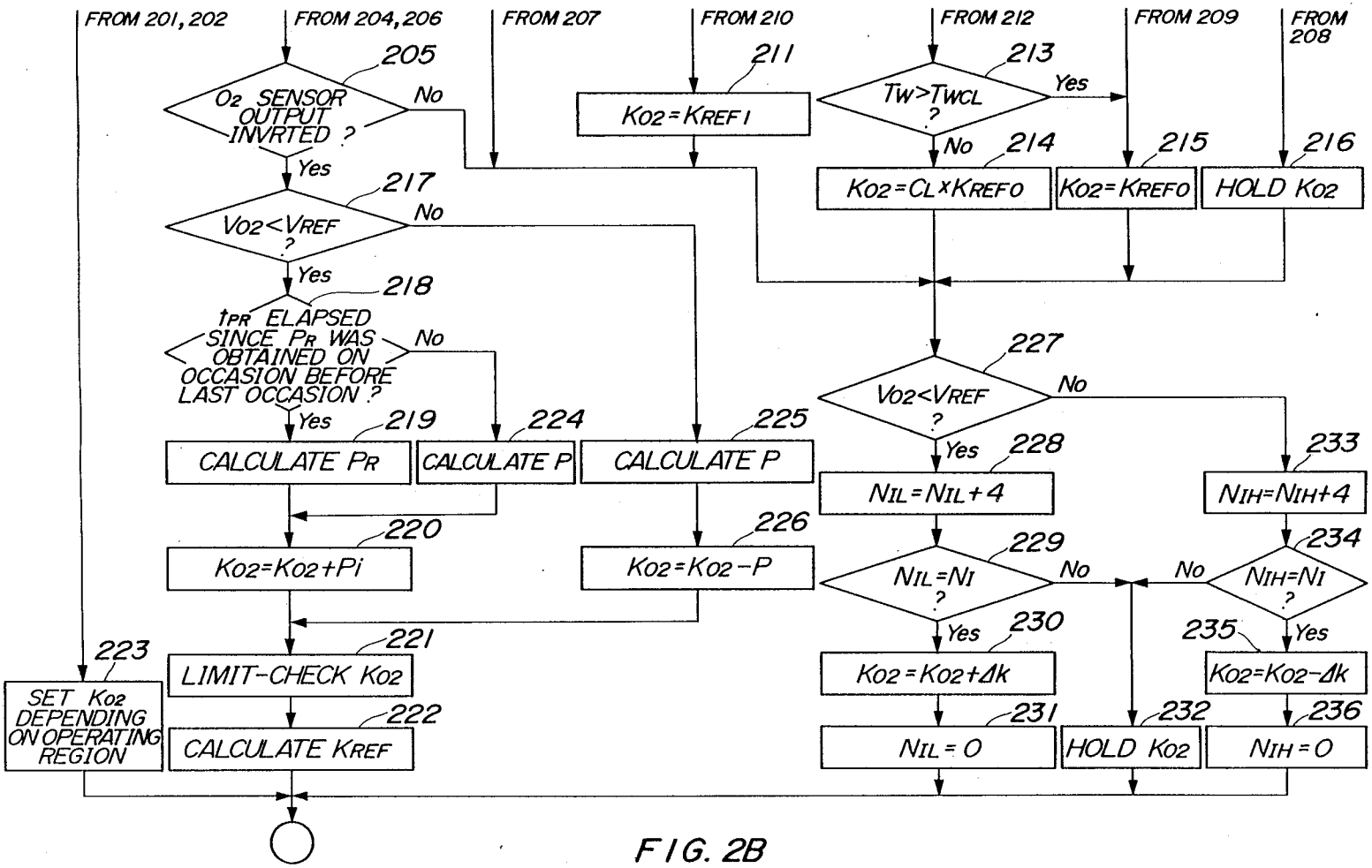

$K_{02}$ is an air-fuel ratio feedback control correction coefficient whose value is determined in response to the oxygen concentration in the exhaust gases by means of a program shown in FIG. 2, during feedback control, while it is set to respective predetermined appropriate values while the engine is in predetermined operating regions (the open-loop control regions) other than the feedback control region.

$K_1$ and $K_2$ are other correction coefficients and correction variables, respectively, which are calculated based on various engine parameter signals to such values as tO optimize characteristics of the engine such as fuel consumption and acceptability depending on the operating conditions of the engine.

The CPU 5*b* supplies through the output circuit 5*d* the fuel injection valves 6 with driving signals corresponding to the calculated fuel injection period $T_{OUT}$ determined as above, over which the fuel injection valves 6 are opened.

FIG. 2 shows a flowchart of a subroutine for calculating the air-fuel ratio feedback control correction coefficient $K_{02}$. This program is carried out in synchronism with inputting of each TDC signal pulse to the ECU 5.

First, it is determined at a step 201 whether or not the $O_2$ sensor 15 has been activated. If the answer is Yes, i.e. if the $O_2$ sensor 15 has been activated, it is determined at a step 202 whether or not the engine is operating in one of the open-loop control regions. If the answer to the question of the step 201 is No, i.e. if the $O_2$ sensor 15 has not been activated, or if the answer to the question of the step 202 is Yes, i.e. if the engine is operating in one of the open-loop control regions, the correction coefficient $K_{02}$ is set to a value depending on the particular open-loop control region at a step 223, followed by terminating the present program.

If the answer to the question of the step 202 is No. i.e. if the engine is operating in the feedback control region, it is determined at a step 203 whether or not open-loop control was carried out in the loop before the immediately preceding loop. If the answer is Yes, it is determined at a step 208 whether or not the value of correction coefficient $K_{02}$ was held at an immediately preceding value in the loop before the immediately preceding loop. If the answer is Yes, the value of correction coefficient $K_{02}$ is held (step 216), and integral control (I-term control) is carried out at steps 227 et seq., described hereinafter.

If the answer to the question of the step 208 is No, i.e. if the value of correction coefficient $K_{02}$ was not held in the loop before the immediately preceding loop, it is determined at a step 209 whether or not the engine is operating in an idling region.

Figure 3:
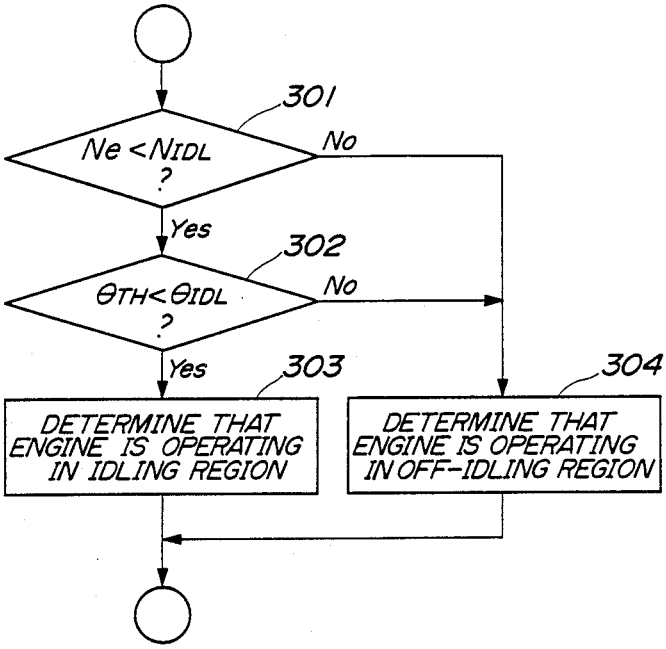
FIG. 3 is a flowchart of a subroutine for determining an idling region, as part of the programs of FIG. 2 and FIG. 4.
Figure 4:
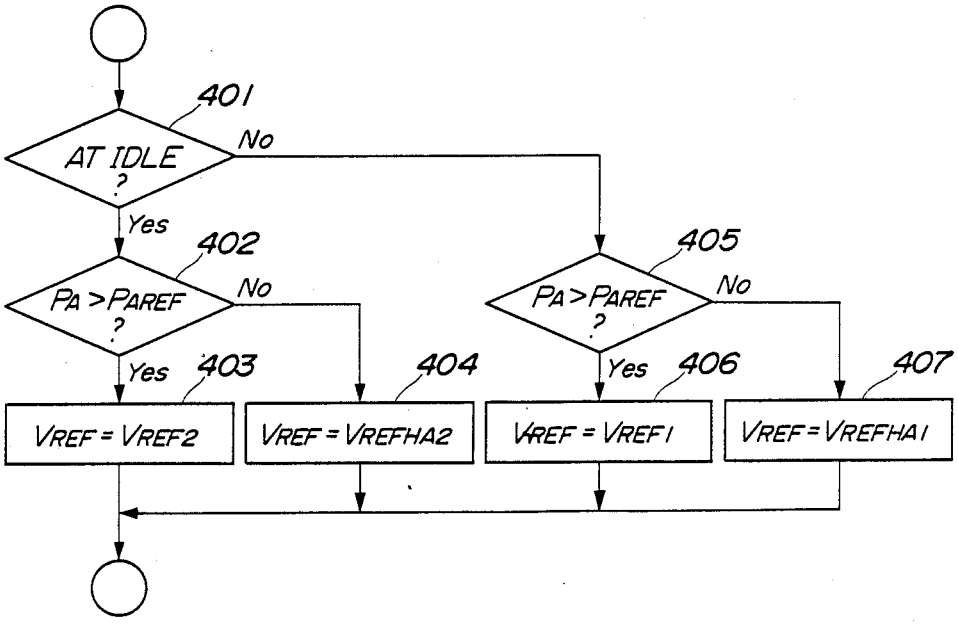
FIG. 4 is a flowchart showing a manner of setting a reference voltage value $V_{REF}$.

The determination as to whether or not the engine is operating in the idling region is carried out in such a manner as shown in FIG. 3. Specifically, it is determined at a step 301 whether or not the engine rotational speed Ne is lower than a predetermined idling speed $N_{IDL}$ (e.g. 1200 rpm). If the answer is Yes, it is determined at a step 302 whether or not the throttle valve opening $\theta_{TH}$ is smaller than a predetermined value $\theta_{IDL}$ (e.g. $2^o$). If the answer is Yes, it is determined at a step 303 that the engine is operating in the idling region. If the answer to the question of the step 301 or the step 302 is No, it is determined at a step 304 that the engine is operating in a region other than the idling region. This determination as to whether or not the engine is operating in the idling region is also carried out in the control program Of FIG. 4, described hereinafter, in the same manner as described above.

Referring again to FIG. 2, if the answer to the question of the step 209 is Yes, i.e. if the engine is operating in the idling region, the correction coefficient $K_{02}$ is set to an average value $K_{REF0}$ for the idling region which was calculated while the engine was in the idling region within the feedback control region, as hereinafter described, at a step 215. Then, steps 227 et seq. are executed to carry out integral control of the air-fuel ratio, as hereinafter described.

If the answer to the question of the step 209 is No, i.e. if the engine is operating in a region within the feedback control region other than the idling region, it is determined at a step 210 whether or not the throttle valve opening $\theta_{TH}$ was greater than the predetermined value $\theta_{IDL}$ in the loop before the immediately preceding loop. If the answer is Yes, the correction coefficient $K_{02}$ is set, at a step 211, to $K_{REF1}$ for off-idling region, an average value of values of $K_{02}$ assumed while the engine is operating in a region within the feedback control region but other than the idling region, which value is calculated in such a manner as described hereinafter, followed by integral control at steps 227 et seq.

If the answer to the question of the step 210 is No, i.e. if $\theta_{TH} \leqq \theta_{IDL}$ in the loop before the immediately preceding loop; it is determined at a step 212 whether or not the throttle valve opening $\theta_{TH}$ is greater than the predetermined value $\theta_{IDL}$ in the presen loop. If the answer is Yes, i.e. if $\theta_{TH} \leqq \theta_{IDL}$ in the loop before the immediately preceding loop and $\theta_{TH} > \theta_{IDL}$ in the present loop, the correction coefficient $K_{02}$ set to a product $C_{R \times KREF1}$ where $K_{REF1}$ is the average value of $K_{02}$ for the off-idling region and $C_R$ is a predetermined enriching value (step 207), followed by integral control at steps 227 et seq. The predermined enriching value $C_R$ is set at a value larger than 1.0, so that the correction coefficient $K_{02}$ is made larger than the average value $K_{REF1}$, whereby the feedback control in a region other than the idling region within the feedback control region when the throttle valve is opened is initiated with the correction coefficient $K_{02}$ set to such a large initial value as to enrich the air-fuel ratio, thus reducing emission of NOx in the exhaust gases.

If the answer to the question of the step 212 is No, i.e. if $\theta_{TH} \leqq \theta_{IDL}$, it is determined at a step 213 whether or not the engine coolant temperature $T_W$ is higher than a predetermined value $T_{WCL}$ (e.g. 70° C.). If the answer is Yes, i.e. if $T_W > T_{WCL}$, and therefore the engine coolant temperature $T_W$ is not in a low temperature range, the program proceeds to the step 215.

If the answer to the question of the step 213 is No, i.e. if $T_W \leqq T_{WCL}$ stands (the engine is in a cold condition), the correction coefficient $K_{02}$ is set to a product $C_L \times K_{REF0}$ obtained by multiplying the average value $K_{REF0}$ for the idling region by a predetermined leaning value $C_L$ at a step 214, followed by execution of the integral control in the steps 227 et seq. The predermined leaning value $C_L$ is set at a value smaller than 1.0 so that the correction coefficient $K_{02}$ is made smaller than the average value $K_{REF0}$ assumed when the the engine coolant temperature $T_W$ is not low, whereby the feedback control in a region other than the idling region within the feedback control region when the engine coolant temperature is low is initiated with the correction coefficient $K_{02}$ set to such a small initial value as to lean the air-fuel ratio, thus reducing emission of CO and HC in the exhaust gases.

If the answer to the question of the step 203 is No, i.e. if feedback control was carried out in the loop before the immediately preceding loop, it is determined at a step 204 whether or not the throttle valve opening $\theta_{TH}$ was greater than the predetermined value $\theta_{IDL}$ in the loop before the immediately preceding loop. If the answer is No, it is further determined at a step 206 whether or not the throttle valve opening $\theta_{TH}$ is greater than the predetermined value $\theta_{IDL}$ in the present loop. If the answer is Yes, similarly to the case where the answer to the question of the step 212 is Yes, the program proceeds to the step 207, where the correction coefficient $K_{02}$ is set to the product $C_R \times K_{REF1}$.

If the answer to the question of the step 204 is Yes, i.e. if $\theta_{TH} > \theta_{IDL}$ in the loop before the immediately preceding loop, or if the answer to the question of the step 206 is No, i.e. if $\theta_{TH} \leqq \theta_{IDL}$ in the present loop, it is determined at a step 205 whether or not the output level of the $O_2$ sensor 15 has been inverted. If the answer is No, integral control is carried out at the steps 227 et seq.

If the answer to the question of the step 205 is Yes, i.e. if the output level of the $O_2$ sensor 15 has been inverted, proportional control (P-term control) is carried out in the following steps. First, it is determined at a step 217 whether or not the output voltage $V_{02}$ of the $O_2$ sensor 15 is lower than a reference voltage $V_{REF}$. The reference voltage $V_{REF}$ is set in the following manner by means of the program of FIG. 4 which will be described below.

First, it is determined at a step 401 whether or not the engine is operating in the idling region. If the answer is No, i.e. if the engine is operating in the off-idling region, it is determined at a step 405 whether or not atmospheric pressure $P_A$ detected by the atmospheric pressure sensor 16 is higher than a predetermined value $P_{AREF}$ (e.g. 650 mmHg). If the answer is Yes, i.e. if $P_A > P_{AREF}$, it is judged that the vehicle is in a low altitude, and at a step 406 the reference voltage $V_{REF}$ is set to a first low altitude reference voltage $V_{REF1}$ (e.g. 0.55V), followed by terminating the present program. If the answer to the question of the step 405 is No, i.e. if $P_A \leqq P_{AREF}$, it is judged that the vehicle is in a high altitude, and at a step 407 the reference voltage $V_{REF}$ is set to a first high altitude reference voltage $V_{REFHA1}$ (e.g. 0.60V), which is higher than the first low altitude reference voltage $V_{REF1}$, followed by terminating the present program.

If the answer to the question of the step 401 is Yes, i.e. if the engine is operating in the idling region, it is also determined at a step 402, similarly to the step 405, whether or not the detected atmospheric pressure $P_A$ is higher than the predetermined value $P_{AREF}$. If the answer is Yes, it is judged that the vehicle is in a low altitude, and at a step 403 the reference voltage $V_{REF}$ is set to a second low altitude reference voltage $V_{REF2}$ (e.g. 0.5V), which is lower than the first low altitude reference voltage $V_{REF1}$, whereas if the answer is No, it is judged that the vehicle is in a high altitude, and at a step 404 the reference voltage $V_{REF}$ is set to a second high altitude reference voltage $V_{REFHA2}$ (e.g. 0.55V), which is lower than the first high altitude reference voltage $V_{REFHA1}$ and higher than the second low altitude reference voltage $V_{REF2}$, followed by terminating the present program.

As described above, there are applied as the reference voltage $V_{REF}$, in the idling region and the off-idling region, the respective low altitude reference voltages $V_{REF1}$ and $V_{REF2}$, and the respective high altitude reference voltages $V_{REFHA1}$ and $V_{REFHA2}$, the voltages being in the relationships of $V_{REF2} < V_{REF1} < V_{REFHA1}$, and $V_{REF2} < V_{REFHA2} < V_{REFHA1}$.

Returning to FIG. 2, if the answer to the question of the step 217 is Yes, i.e. if $V_{02} < V_{REF}$, it is determined at a step 218 whether or not a predetermined period of time $t_{PR}$ has elapsed after a second correction value $P_R$, which will be referred to hereinafter, was applied on the occasion before the immediately preceding occasion.

This predetermined period of time $t_{PR}$ is provided to maintain constant the frequency of application of the second correction value $P_R$ throughout the entire engine rotational speed range. To this end, the time period $t_{PR}$ is set to smaller values as the engine rotational speed Ne becomes higher. If the answer to the question of the step 218 is Yes, a value of the second correction value $P_R$ corresponding to the engine rotational speed Ne is read from an Ne-$P_R$ table, at a step 219, while if the answer is No, a value of a first correction value P corresponding to the engine rotational speed Ne is read from an Ne-P table, at a step 224. Values of the first correction value P within the Ne-P table are smaller than respective corresponding ones of the second correction value $P_R$ within the Ne-$P_R$ table. Then, a correction value $P_i$, i.e. the read first correction value P or the read second correction value $P_R$, is added to the correction coefficient $K_{02}$, at a step 220. Thus, if the output level of the $O_2$ sensor 15 has been inverted and at the same time the output voltage $V_{02}$ after the invertion is lower than the reference voltage $V_{REF}$, it is judged that the air-fuel ratio has been changed from a rich state to a lean state, and the correction value P or $P_R$ depending on the engine rotational speed Ne is added to the correction coefficient $K_{02}$ to thereby enrich the air-fuel ratio.

Meanwhile, if the answer to the question of the step 217 is No, i.e. if $V_{02} \geqq V_{REF}$, similarly to the step 224, a value of the first correction value P corresponding to the engine rotational speed Ne is read from the Ne-P table, at a step 225, and the first correction value P is subtracted from the correction coefficient $K_{02}$ at a step 226. Thus, if the output level of the $O_2$sensor 15 has been inverted and at the same time the output voltage $V_{02}$ after the invertion is equal to or higher than the reference voltage $V_{REF}$, it is judged that the air-fuel ratio has been changed from a lean state to a rich state, and the correction value P corresponding to the engine rotational speed Ne is subtracted from the correction coefficient $K_{02}$ to thereby lean the air-fuel ratio.

As described above, the correction coefficient $K_{02}$ is so controlled as to enrich the air-fuel ratio when $V_{02} < V_{REF}$ and lean same when $V_{02} \geqq V_{REF}$. Therefore, as the reference voltage $V_{REF}$ is set at a higher value, the frequency of enriching the air-fuel ratio is increased. For instance, suppose that the $O_2$ sensor has been activated, and the output voltage $V_{02}$ varies within a range of 0.1V to 0.9V. If $V_{REF}$ is set to 0.5V, it is determined when $V_{02}$ is in a range of 0.1V to 0.5V that the air-fuel ratio is lean, and when $V_{02}$ is in a range of 0.5V to 0.9V that the air-fuel ratio is rich. However, if $V_{REF}$ is set to 0.55V, it is determined when $V_{02}$ is in a range of 0.1V to 0.55V that the air-fuel ratio is lean, and when V02 is in a range of 0.55V to 0.9V that the air-fuel ratio is rich. Therefore, the frequency of determination that the air-fuel ratio is lean is increased when $V_{REF}$ is set to 0.55V, and accordingly, the air-fuel ratio is enriched more often. In other words, as the reference voltage $V_{REF}$ is set to a higher value, the desired air-fuel ratio by the feedback control is shifted to a richr value.

As described above, depending on the detected atmospheric pressure $P_A$, there are applied as the reference voltage $V_{REF}$, in both of the idling region and the off-idling region, the respective low altitude reference voltages $V_{REF1}$ and $V_{REF2}$, and the respective high altitude reference voltages $V_{REFHA1}$ and $V_{REFHA2}$, which are higher than the corresponding low altitude reference voltages. Therefore, when the vehicle is in a high altitude, the desired air-fuel ratio which is to be attained by the feedback control is shifted to a richer value than when the vehicle is in a low altitude. In other words, if the desired air-fuel ratio to be applied in a high altitude is the same as that to be applied in a low altitude, it is impossible to prevent increase in the emission of NOx in the exhaust gases, which results from leaning of the air-fuel ratio due to lowering of atmospheric pressure accompanying increased altitude, and elevation of the combustion temperature of the air-fuel mixture resulting from increase in the frequency of high load operation of the engine in a high altitude. Therefore, in a high altitude, the reference voltage $V_{REF}$ is set to a higher value than in a low altitude, whereby the desired air-fuel ratio to be attained by the feedback control is shifted to a richer value so as to obtain excellent exhaust emission characteristics in both the high altitude and the low altitude.

Further, by virtue of the provision of $V_{REF1}$ for the off-idling region and $V_{REF2}$ for the idling region as the low altitude reference voltages, and setting up the relationship of $V_{REF1} > V_{REF2}$, it is possible to prevent increase in the emission of HC and CO, which is more likely to occur in the idling region than in a region within the feedback control region other than the idling region. In other words, the reference voltage $V_{REF}$ is set at a lower value in the idling region than in a region within the feedback control region other than the idling region to thereby shift the desired air-fuel ratio to a leaner value.

Referring again to FIG. 2, the limit checking of a value of correction coefficient $K_{02}$ set at the proportional control is carried out at a step 221. More specifically, it is checked that the calculated value of correction coefficient $K_{02}$ is within a predetermined range. If the correction coefficient $K_{02}$ is outside the predetermined range, it is held at the lower or upper limit value of the predetermined range.

The value of the correction coefficient $K_{02}$ thus set is substituted into an equation (2) given below to calculate an average value $K_{REF}$ at a step 222, and the calculated average value $K_{REF}$ stored into the memory, followed by terminating the present program. As the average value $K_{REF}$, the average value $K_{REF0}$ for the idling region is calculated when the engine is operating in the idling region within the feedback control region, and the average value $K_{REF1}$ when the engine is operating in another region within the feedback control region, respectively:

$$K_{REF} = K_{02P} \times (C_{REF}/A) + K_{REF} \times (A - C_{REF})/A \quad (2)$$

where $K_{02P}$ represents a value of $K_{02}$ obtained immediately before or immediately after execution of the proportional control (P-term control), A an averaging constant, $C_{REF}$ an averaging variable experimentally obtained, which is set to an appropriate value between 1 and A, and $K_{REF}$ an average value of values of the coefficient $K_{02}$ obtained so far through past operation of the engine and stored.

Since the ratio of $K_{02P}$ to $K_{REF}$ assumed in each execution of the P-term control depends upon the variable $C_{REF}$, it is possible to freely set the degree of precision of calculation of the average value $K_{REF}$ ($K_{REF0}$ and $K_{REF1}$) by setting the $C_{REF}$ value at a value between 1 and A that best suits the type of an air-fuel ratio feedback control system, an engine, etc. to be applied.

Next, the integral control executed at the steps 227 et seq. will be described. First, it is determined at the step 227 whether or not the output voltage of the $O_2$ sensor 15 is lower than the reference voltage $V_{REF}$. If the answer is Yes, i.e. if $V_{02} < V_{REF}$, a value of 4 is added to $N_{IL}$, a counted number of pulses of the TDC signal, at a step 228, and it is determined at a step 229 whether or not the counted pulse number $N_{IL}$ has reached a predetermined value $N_I$. If the answer is No, the correction coefficient $K_{02}$ is held at an immediately preceding value at a step 232, while if the answer is Yes, a predetermined value $\Delta k$ is added to the coefficient $K_{02}$ at a step 230, and the counted pulse number is reset to 0 at a step 231. In this way, whenever the counted pulse number $N_{IL}$ reaches the predetermined value $N_I$, the coefficient $K_{02}$ is increased by the predetermined value $\Delta k$.

Thus, so long as the state in which the output voltage $V_{02}$ of the $O_2$ sensor 15 is lower than the reference voltage $V_{REF}$, i.e. the state in which the air-fuel ratio is lean continues, the correction coefficient $K_{02}$ is increased by the predetermined value $\Delta k$ whenever the counted pulse number $N_{IL}$ reaches the predetermined value $N_I$ to thereby enrich the air-fuel ratio.

Meanwhile, if the answer to the question of the step 227 is No, i.e. if $V_{02} \geqq V_{REF}$, a value of 4 is added to $N_{IH}$, a counted number of pulses of the TDC signal, at a step 233, whenever the present step is executed, and it is determined at a step 234 whether or not the counted pulse number $N_{IH}$ has reached a predetermined value $N_I$. If the answer is No, the correction coefficient $K_{02}$ is held at an immediately preceding value at the step 232, while if the answer is Yes, the predetermined value $\Delta k$ is subtracted from the coefficient $K_{02}$ a step 235, and the counted pulse number $N_{IH}$ is reset to 0 at a step 236. In this way, whenever the counted pulse number $N_{IH}$ reaches the predetermined value $N_I$, the correction coefficient $K_{02}$ is decreased by the predetermined value $\Delta k$.

Thus, so long as the state in which the output voltage $V_{02}$ is equal to or higher than the reference voltage $V_{REF}$, i.e. the state in which the air-fuel ratio is rich continues, the correction coefficient $K_{02}$ is decreased by the predetermined value $\Delta k$ whenever the counted pulse number $N_{IH}$ reaches the predetermined value $N_I$ to thereby lean the air-fuel ratio.

As described above, in the integral control, so long as the output voltage $V_{02}$ of the $O_2$ sensor 15 and the reference voltage $V_{REF}$ maintain the relationship of $V_{02} < V_{REF}$, the correction coefficient $K_{02}$ is controlled so as to enrich the air-fuel ratio, while so long as the relationship of $V_{02} \geqq V_{REF}$ is maintained, the correction coefficient $K_{02}$ is controlled so as to lean the air-fuel ratio. Therefore, as the reference volta $V_{REF}$ is set at a higher value, the ratio of time over which the air-fuel ratio is enriched is increased as compared with the ratio of time over which the air-fuel ratio is leaned. Therefore, it is possible to properly control the air-fuel ratio in both of the idling and off-idling regions within the feedback control region irrespective of the altitude in which the vehicle is running by setting the reference voltage $V_{REF}$, as described before with reference to the proportional control, to a value conforming to the operating region (the idling region or off-idling region) and atmospheric pressure $P_A$ (which depends on the altitude at which the vehicle is running).

As described above in detail, according to the invention, it is possible to prevent increase in the emission of NOx in high altitudes, which results from leaning of the air-fuel ratio due to decrease in atmospheric pressure at higher altitude, as well as from a rise in the combustion temperature of the air-fuel mixture caused by increased frequency of high load operation of the engine at higher altitude to cope with the tendency toward insufficiency of the engine output. Thus, excellent exhaust emission characteristics can be secured irrespective of the altitude at which the vehicle is running.

What is claimed is:

1. A method of effecting feedback control of the air-fuel ratio of an air-fuel mixture being supplied to an internal combustion engine having an exhaust system, and a sensor arranged in said exhaust system for sensing a value of the concentration of an ingredient in exhaust gases from said engine, wherein when said engine is operating in a feedback control region, the value of the concentration of said ingredient detected by said sensor is compared with a reference value, and the air-fuel ratio of the air-fuel mixture is controlled to a desired value in a feedback manner responsive to the result of the comparison, the method comprising the steps of:

(1) detecting a value of atmospheric pressure; and (2) setting said reference value to a value depending on the detected value of atmospheric pressure, said reference value being set to different values between when said engine is operating in an idling region within said feedback control region and when said engine is operating in a region within said feedback control region other than said idling region.

2. A method of effecting feedback control of the air-fuel ratio of an air-fuel mixture being supplied to an internal combustion engine having an exhaust system, and a sensor arranged in said exhaust system for sensing a value of the concentration of an ingredient in exhaust gases from said engine, wherein when said engine is operating in a feedback control region, the value of the concentration of said ingredient detected by said sensor is compared with a reference value, and the air-fuel ratio of the air-fuel mixture is controlled to a desired value in a feedback manner responsive to the result of the comparison, the method comprising the steps of:

(1) detecting a value of atmospheric pressure; and (2) setting said reference value to a higher value as the detected value of atmospheric pressure is lower, said reference value being set to different values between when said engine is operating in an idling region within said feedback control region and when said engine is operating in a region within said feedback control region other than said idling region.

3. The method as claimed in claim 1 or claim 2, wherein said reference value is set to a lower value when said engine is operating in said region other than said idling region.

* * * * *